US012635750B2

(12) United States Patent
Boden

(10) Patent No.: US 12,635,750 B2
(45) Date of Patent: May 26, 2026

(54) PROTECTIVE FACE SHIELD HAT

(71) Applicant: Robert O. Boden, Altadena, CA (US)

(72) Inventor: Robert O. Boden, Altadena, CA (US)

( * ) Notice: Subject to any disclaimer, the term of this patent is extended or adjusted under 35 U.S.C. 154(b) by 0 days.

(21) Appl. No.: 18/822,817

(22) Filed: Sep. 3, 2024

(65) Prior Publication Data

US 2026/0060355 A1 Mar. 5, 2026

(51) Int. Cl.
*A42B 1/0181* (2021.01)
*A41D 13/11* (2006.01)

(52) U.S. Cl.
CPC ..... *A42B 1/0181* (2021.01); *A41D 13/1184* (2013.01)

(58) Field of Classification Search
CPC ..... A42B 1/019; A42B 1/018; A42B 1/0181; A42B 1/0182; A42B 1/0186; A42B 1/0187; A42B 1/205; A42B 1/208; A42B 1/22; A42B 3/08; A42B 3/14; A42B 7/00; A42C 5/04; A41D 13/1184
See application file for complete search history.

(56) References Cited

U.S. PATENT DOCUMENTS 573,492 A * 12/1896 Standfield et al. ..... A42B 7/00 132/63.1
588,241 A * 8/1897 Ray ..... A42C 5/04 238/148
854,368 A * 5/1907 Marshall ..... A42B 7/00 132/61
1,144,561 A * 6/1915 Morris ..... A42B 7/00 132/61
1,252,855 A * 1/1918 Sorocinksky ..... A42B 7/00 132/72.1
1,424,666 A * 8/1922 Muehle ..... A42B 7/00 132/65.1
1,497,901 A * 6/1924 Greenberg ..... A42B 7/00 132/59
1,684,610 A * 9/1928 Weir ..... A42B 1/22 2/181
1,810,157 A * 6/1931 Bullard ..... A42C 5/04 2/5
1,935,204 A * 11/1933 Dym ..... A42B 3/28 D29/104
2,573,250 A * 10/1951 Daly ..... A42B 3/14 2/419
2,614,255 A * 10/1952 Ellis ..... A61F 9/045 2/454

(Continued)

*Primary Examiner* — Heather Mangine
(74) *Attorney, Agent, or Firm* — Womble Bond Dickinson (US) LLP

(57) ABSTRACT

A face shield hat and its components are disclosed. In some examples, the face shield hat includes a hat brim, a hat crown, and a shield attached to the hat brim. The shield may encircle most of a user's head when the face shield hat is worn. The shield may extend downwards or hang below the hat brim. The shield may be attached to the hat brim via multiple snap fitting slots. The face shield hat may include multiple drawstring holes configured to receive at least one drawstring. The at least one drawstring may include two portions that rest atop a head of a wearer of the face shield hat and below the hat crown. Other portions of the at least one drawstring may extend downwards from the hat brim and may be attached to a drawstring lock to be secured around a chin of a wearer.

17 Claims, 5 Drawing Sheets

(56) References Cited

U.S. PATENT DOCUMENTS 3,557,386 A * 1/1971 Fisher ..... A42B 1/205 2/171.02
4,439,871 A * 4/1984 Plastino ..... A42B 1/08 2/418
4,701,965 A * 10/1987 Landis ..... A42B 1/0181 2/9
4,850,049 A * 7/1989 Landis ..... A42B 1/012 2/9
4,852,186 A * 8/1989 Landis ..... A61F 9/02 2/9
4,864,653 A * 9/1989 Landis ..... A42B 1/0181 2/9
4,920,576 A * 5/1990 Landis ..... A41D 13/1184 2/9
4,945,573 A * 8/1990 Landis ..... A41D 13/1184 351/158
4,964,171 A * 10/1990 Landis ..... A61F 9/02 2/9
5,369,809 A * 12/1994 Hall ..... A41D 3/00 2/202
5,673,431 A * 10/1997 Batty ..... A61F 9/027 2/9
5,694,647 A * 12/1997 Crickmore ..... A42B 1/0187 2/172
5,802,617 A * 9/1998 Boden ..... A42C 5/04 2/181.2
5,901,380 A * 5/1999 Mishal ..... A42B 1/0187 2/202
5,950,241 A * 9/1999 Gomez ..... A42B 1/201 2/172
6,151,712 A * 11/2000 Lampi ..... A42B 7/00 2/10
D544,679 S * 6/2007 Almeida ..... D2/866
D826,521 S * 8/2018 Foster ..... A42B 1/0181 D2/886
D843,087 S * 3/2019 Foster ..... A42B 1/0181 D2/886
2002/0162160 A1* 11/2002 Anderson ..... A42B 1/22 2/200.1
2004/0098789 A1* 5/2004 Carey ..... A42B 1/046 2/173
2009/0229028 A1* 9/2009 Dobkins ..... A42B 1/247 2/10
2010/0257659 A1* 10/2010 Hitch ..... A42B 1/18 2/172
2011/0099691 A1* 5/2011 Duwyn-Zylstra ..... A42B 1/22 2/175.1
2013/0145525 A1* 6/2013 Arenson ..... A42B 1/06 2/424
2015/0047112 A1* 2/2015 Foster ..... A42B 1/0186 2/422
2016/0050990 A1* 2/2016 Hayes ..... A42B 1/0181 2/9
2016/0128417 A1* 5/2016 Hickey ..... A42B 1/0182 2/195.1
2016/0255895 A1* 9/2016 Shedd ..... A42B 1/22
2019/0200696 A1* 7/2019 Layton ..... A42B 7/00
2020/0214382 A1* 7/2020 Dann ..... A42B 1/225
2020/0253317 A1* 8/2020 Niedermeyer ..... A42B 7/00
2021/0145107 A1* 5/2021 Pracht ..... A42B 3/0406
2021/0298380 A1* 9/2021 Brown, II ..... A42B 1/0181
2021/0321690 A1* 10/2021 Travis ..... A42B 1/0181
2021/0321693 A1* 10/2021 Wilson ..... A42B 1/0182
2021/0339269 A1* 11/2021 Kuntz ..... A62B 7/10
2021/0345721 A1* 11/2021 Hoppe ..... A42B 3/225
2021/0378340 A1* 12/2021 Capobianco ..... A42B 3/105
2022/0053868 A1* 2/2022 Baker ..... A41D 13/1107
2022/0125137 A1* 4/2022 Landis ..... A42B 1/0182
2022/0192303 A1* 6/2022 Tezcucano Boy ... A42B 1/0195
2022/0346482 A1* 11/2022 Hodgdon ..... A42B 1/0186
2023/0000193 A1* 1/2023 Michaels ..... A42B 1/22

* cited by examiner

100

100

100

100

100

PROTECTIVE FACE SHIELD HAT

BACKGROUND

Face shields have been widely utilized in various industries and healthcare settings as personal protective equipment (PPE) to protect the wearer from airborne particles, droplets, and splashes. Traditionally, face shields are attached to headgear or helmets, offering limited coverage and potentially restricting wearer comfort and mobility.

Hats, on the other hand, are commonly worn for various purposes, including sun protection, fashion, and occupational needs. While hats provide head coverage, they typically lack facial protection.

There is a recognized need for a combined protective solution that offers both head and face coverage while ensuring comfort, mobility, and ease of use.

It is with respect to this general technical environment that aspects of the present technology disclosed herein have been contemplated. Furthermore, although a general environment is discussed, it should be understood that the examples described herein should not be limited to the general environment identified herein.

SUMMARY

This summary is provided to introduce a selection of concepts in a simplified form that are further described below in the Detailed Description. This summary is not intended to identify key features or essential features of the claimed subject matter, nor is it intended to be used as an aid in determining the scope of the claimed subject matter.

In an aspect, the present application relates to a face shield hat, comprising: a hat brim; a hat crown attached to the hat brim; and a shield attached to the hat brim around at least a portion of the hat brim and extending downwards from the hat brim, wherein the hat brim has a plurality of drawstring holes configured to receive at least one drawstring.

In some examples, a first back shield edge and a second back shield edge of the shield are closer to an inner brim edge of the hat brim than an outer brim edge of the hat brim, and wherein a front shield portion of the shield is closer to the outer brim edge than the inner brim edge.

In some examples, an outside surface of the shield is substantially perpendicular to a bottom surface of the hat brim.

In some examples, the shield wraps around more than half of the face shield hat.

In some examples, the hat brim has a plurality of snap fitting slots.

In some examples, the shield has a plurality of snap fitting tabs configured to snap into the plurality of snap fitting slots.

In some examples, the face shield hat further comprises the at least one drawstring, the at least one drawstring comprising: a first drawstring portion of the at least one drawstring extending from a first drawstring hole of the plurality of drawstring holes defined in the hat brim to a second drawstring hole of the plurality of drawstring holes defined in the hat brim; and a second drawstring portion of the at least one drawstring extending from a third drawstring hole of the plurality of drawstring holes defined in the hat brim to a fourth drawstring hole of the plurality of drawstring holes defined in the hat brim.

In some examples, the first drawstring portion and the second drawstring portion are configured to rest atop a head of a wearer of the face shield hat, and when the first drawstring portion and the second drawstring portion rest atop the head of a wearer of the face shield hat, there is a gap between the head of the wearer of the face shield hat and a lower crown surface of the hat crown.

In some examples, the first drawstring portion and the second drawstring portion are disposed underneath the face shield hat.

In some examples, a first knot is tied in the at least one drawstring below the second drawstring hole and at an underside of the hat brim, and wherein a second knot is tied in the at least one drawstring below the fourth drawstring hole at the underside of the hat brim.

In some examples, the at least one drawstring further comprises: a third drawstring portion of the at least one drawstring extending from a fifth drawstring hole of the plurality of drawstring holes defined in the hat brim; and a fourth drawstring portion of the at least one drawstring extending from a sixth drawstring hole of the plurality of drawstring holes defined in the hat brim.

In some examples, the third drawstring portion and the fourth drawstring portion are attached to a drawstring lock.

In some examples, the shield comprises a front shield portion that extends further downwards than the rest of the shield.

In some examples, at least a portion of the shield is a substantially cylindrical shell with a gap.

In some examples, the gap is disposed opposite a front shield portion of the shield.

In some examples, a transverse cross section of the shield defines a major arc.

In some examples, the hat brim, the hat crown, and the shield are made of a same nonporous flat plastic sheeting material.

In another aspect, the present application relates to a face shield hat, comprising: a face shield hat, comprising: a hat brim; a hat crown attached to the hat brim; and a shield attached to the hat brim around at least a portion of the hat brim and extending downwards from the hat brim, wherein the shield includes a plurality of tabs, wherein the hat brim has a plurality of snap fitting slots, and wherein each tab of the plurality of tabs is configured to fit into a respective snap fitting slot of the plurality of snap fitting slots.

In some examples, the face shield hat further comprises a plurality of drawstring holes configured to receive at least one drawstring.

In another aspect, the present application relates to a face shield hat, comprising: a face shield hat, comprising: a hat brim; a hat crown attached to the hat brim; and a shield attached to the hat brim, wherein the hat brim has a plurality of drawstring holes configured to receive at least one drawstring, wherein the hat brim has a plurality of snap fitting slots, and wherein the shield is configured to attach to the hat brim via the plurality of snap fitting slots.

It is to be understood that both the foregoing general description and the following Detailed Description are explanatory and are intended to provide further aspects and examples of the disclosure as claimed.

BRIEF DESCRIPTION OF THE DRAWINGS

The following drawing figures, which form a part of this application, are illustrative of aspects of systems and methods described below and are not meant to limit the scope of the disclosure in any manner, which scope shall be based on the claims.

Figure 1:
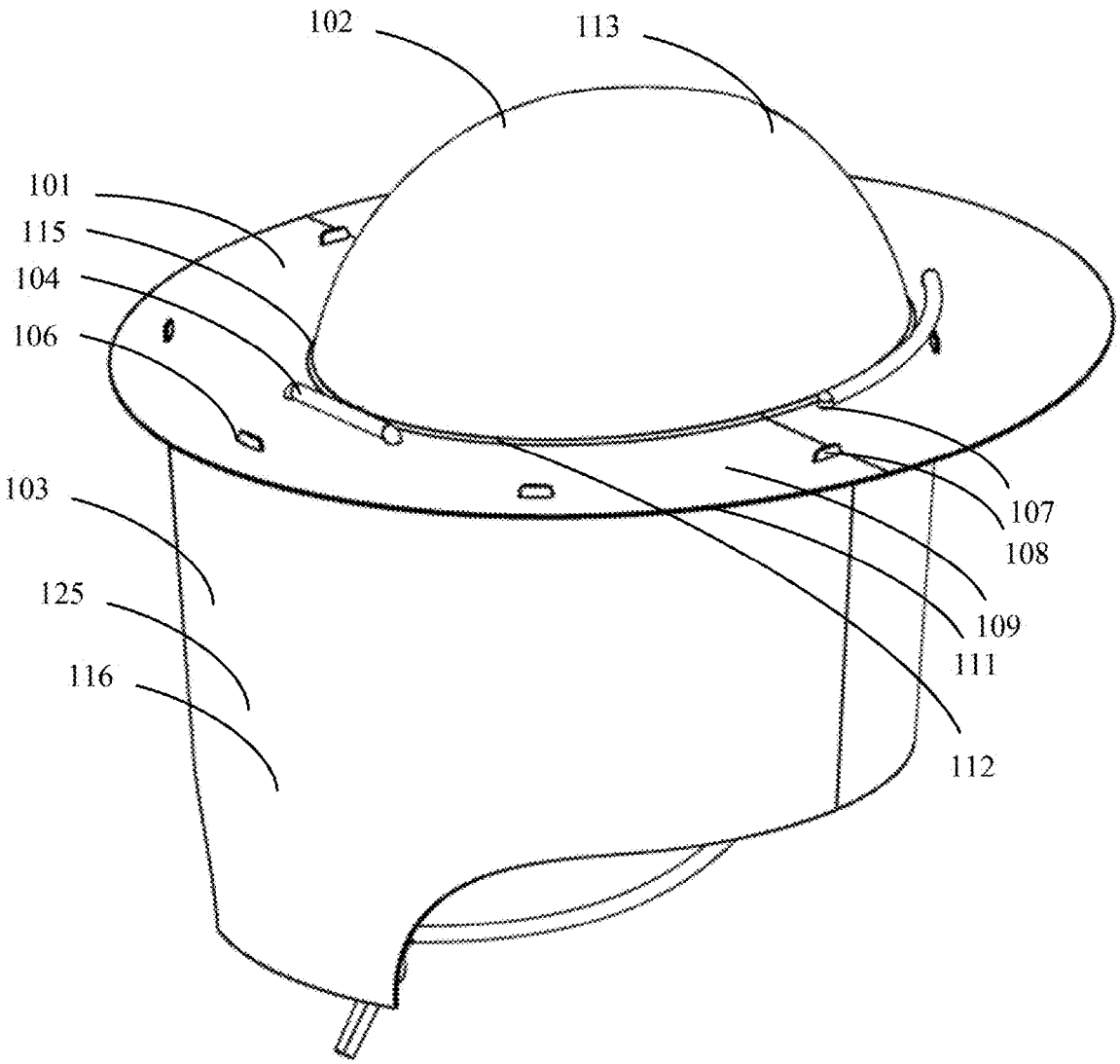
FIG. 1 illustrates an example face shield hat from a perspective view.

While examples of the disclosure are amenable to various modifications and alternative forms, specific aspects have been shown by way of example in the drawings and are described in detail below. The intention is not to limit the scope of the disclosure to the particular aspects described. On the contrary, the disclosure is intended to cover all modifications, equivalents, and alternatives falling within the scope of the disclosure and the appended claims.

DETAILED DESCRIPTION

Face shields have been widely utilized in various industries and healthcare settings as personal protective equipment (PPE) to protect the wearer from airborne particles, droplets, and splashes. Traditionally, face shields are attached to headgear or helmets, offering limited coverage and potentially restricting wearer comfort and mobility.

Hats, on the other hand, are commonly worn for various purposes, including sun protection, fashion, and occupational needs. While hats provide head coverage, they typically lack facial protection.

There is a recognized need for a combined protective solution that offers both head and face coverage while ensuring comfort, mobility, and ease of use. The present invention addresses this need by providing a face shield hat that effectively combines the protective features of a face shield with the comfort and practicality of a hat.

The present disclosure provides examples of a face shield hat. In some examples, the face shield hat includes a hat brim, a hat crown, and a shield attached to the hat brim. The shield may encircle most of a user's head when the face shield hat is worn. The shield may extend downwards or hang below the hat brim. The shield may be attached to the hat brim via multiple snap fitting slots. The face shield hat may include multiple drawstring holes configured to receive at least one drawstring. The at least one drawstring may include two portions that rest atop a head of a wearer of the face shield hat and below the hat crown. Other portions of the at least one drawstring may extend downwards from the hat brim and may be attached to a drawstring lock to be secured around a chin of a wearer.

Figure 2:
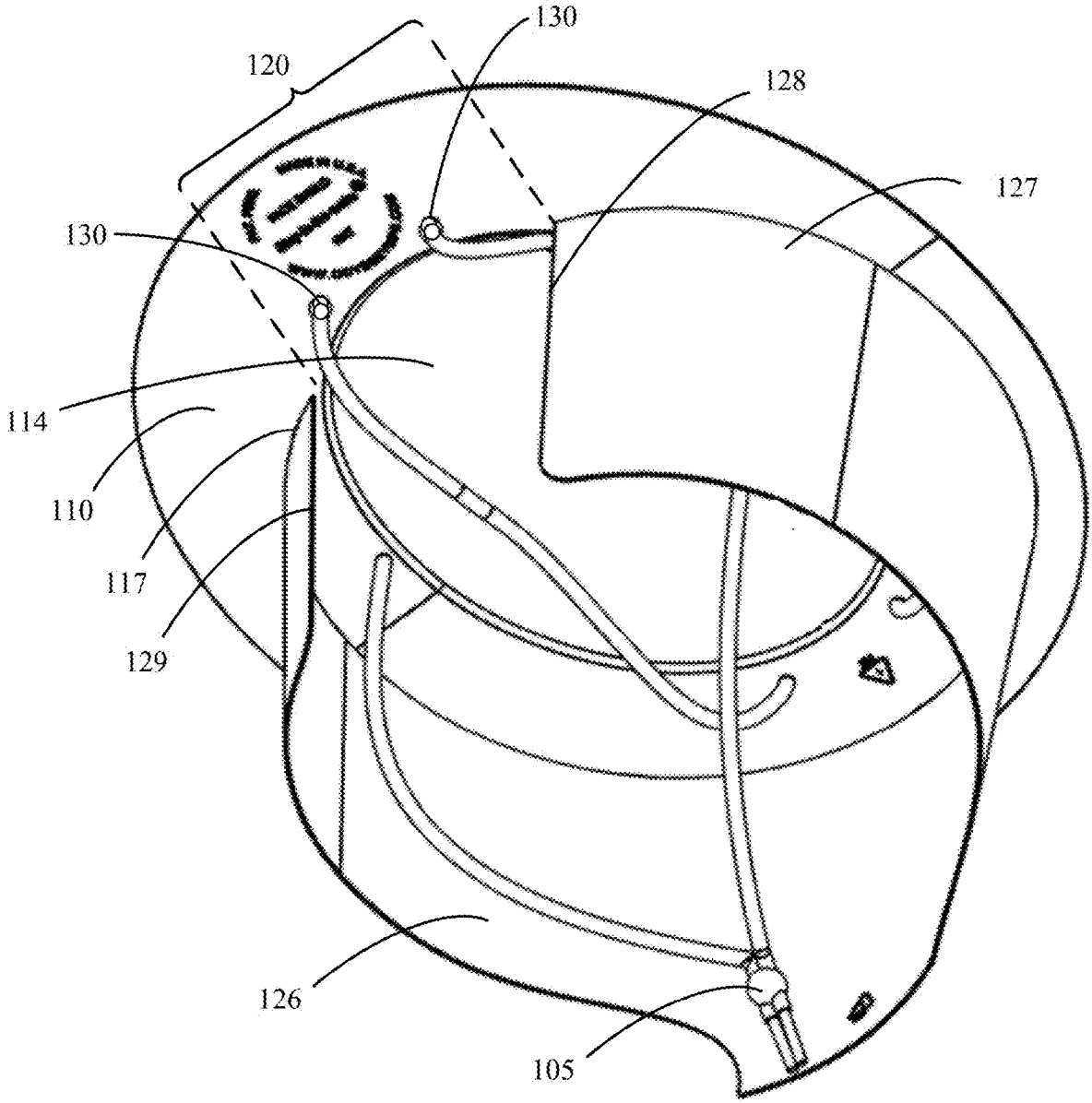
FIG. 2 illustrates an example face shield hat from another perspective view.
Figure 3:
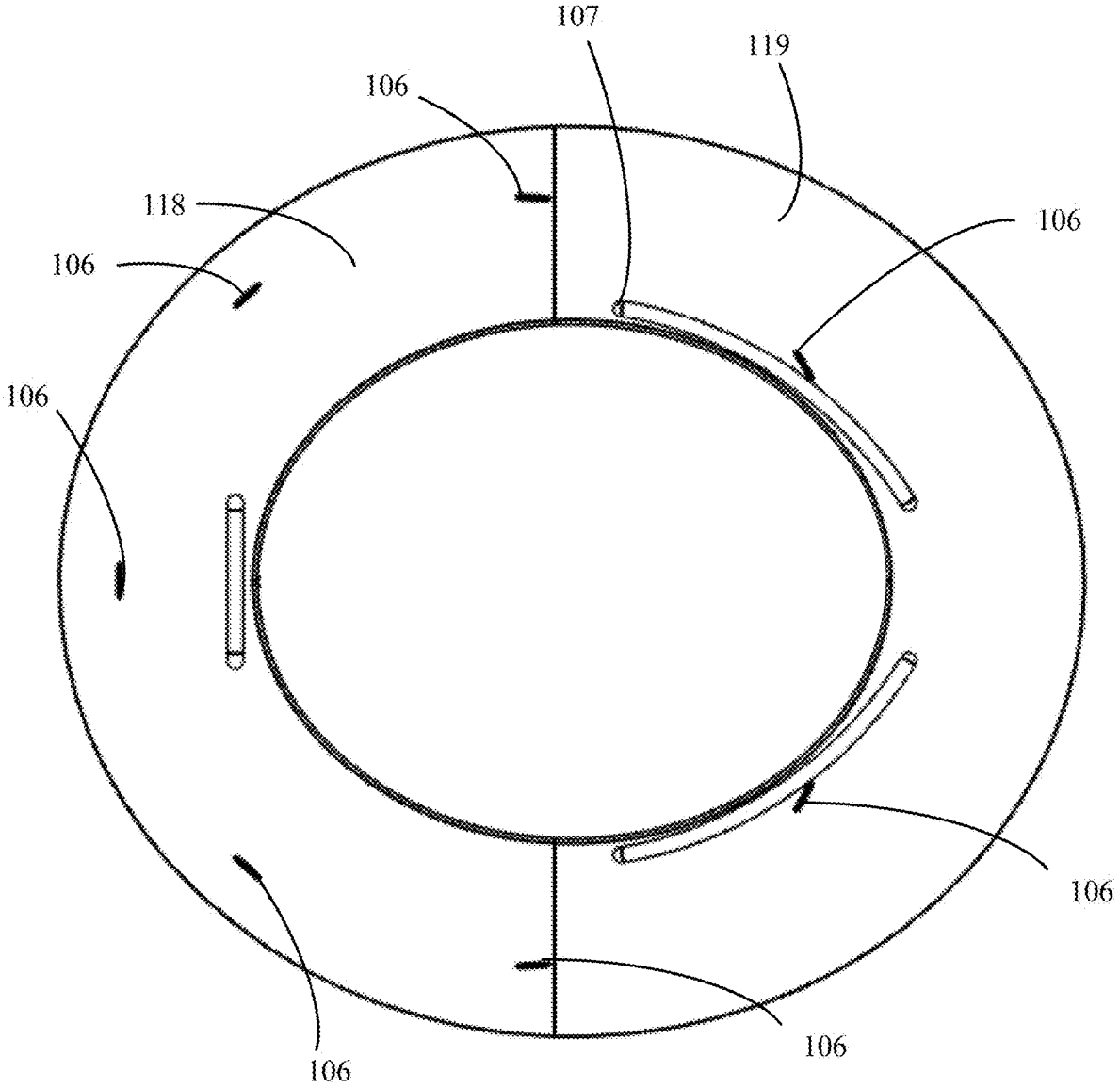
FIG. 3 illustrates an example face shield hat from a top view.
Figure 4:
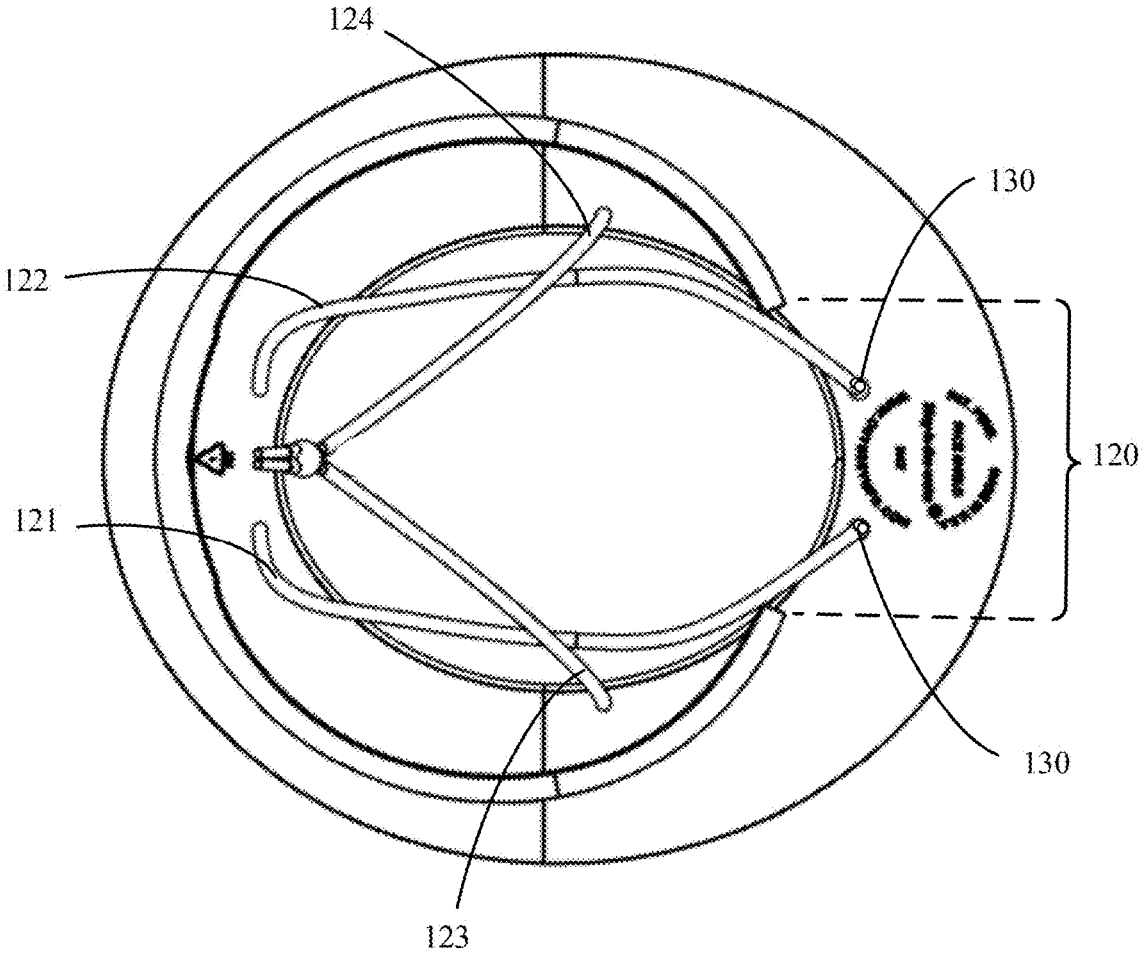
FIG. 4 illustrates an example face shield hat from a bottom view.
Figure 5:
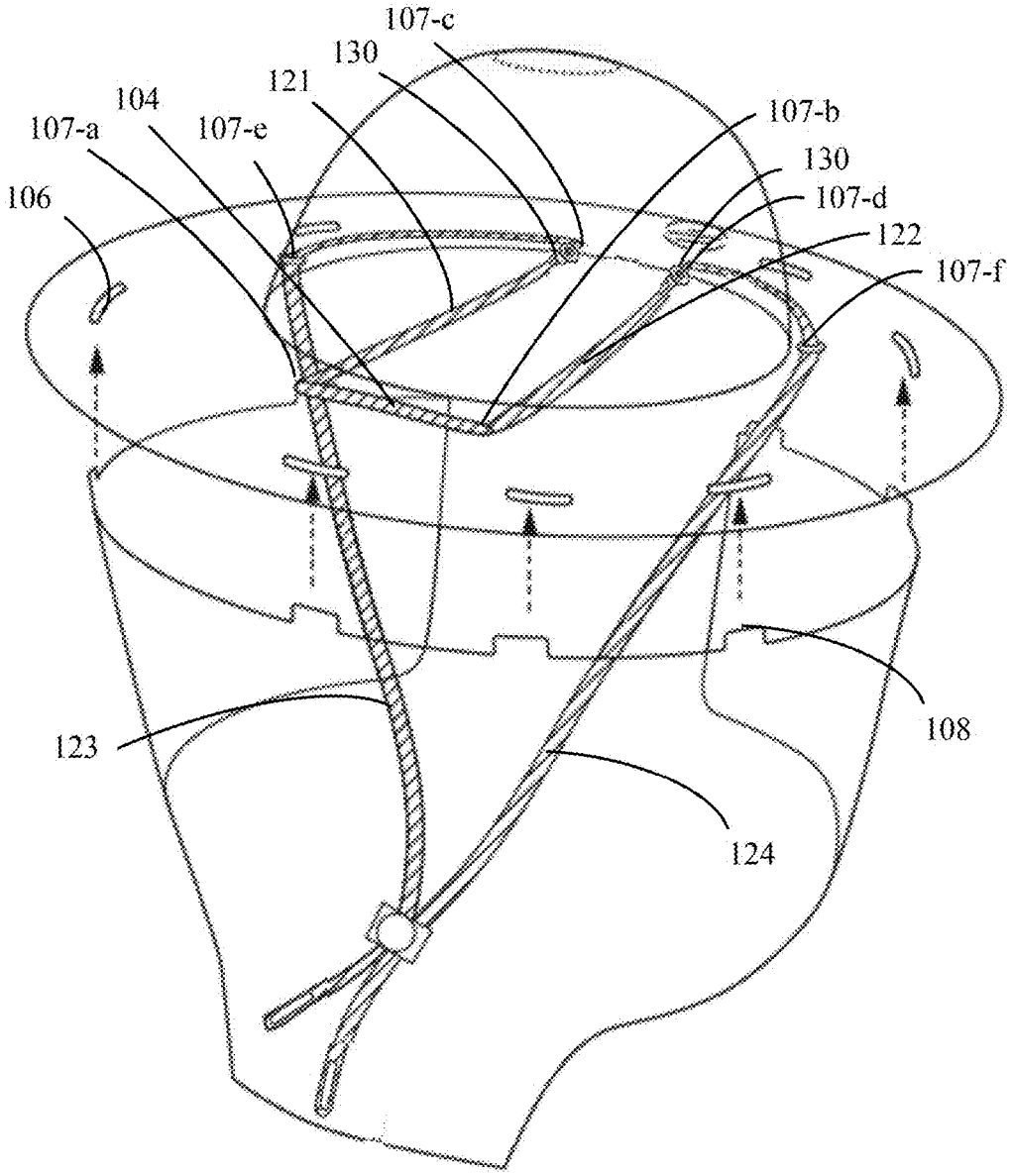
FIG. 5 illustrates an example face shield hat from an exploded view.

FIGS. 1-5 illustrate an example face shield hat. Referring concurrently to FIGS. 1-5, face shield hat 100 includes hat brim 101, hat crown 102, shield 103, at least one drawstring 104, and drawstring lock 105 (FIG. 2). Hat brim 101 includes snap fitting slots 106 and drawstring holes 107. Shield 103 includes tabs 108.

In some examples, hat brim 101 and hat crown 102 may form a single integral part. For example, hat brim 101 and/or hat crown 102 may be formed in a sewing, casting, stamping, or molding process, although other manufacturing processes are possible and contemplated. In other examples, hat brim 101 and hat crown 102 may be separately formed and coupled to one another via any suitable process, such as adhesive-based coupling, stitching, bonding (e.g., heat bonding), fasteners, or the like.

Alternative hat designs may be contemplated. It is contemplated that the features described herein are applicable to substantially any hat, apparel, or wearable object on the head.

Hat brim 101 includes a top brim surface 109 and a bottom brim surface 110 (FIG. 2), both extending circumferentially around hat crown 102. In some examples, top brim surface 109 and bottom brim surface 110 are substantially flat or planar and separated by a thickness of hat brim 101, creating two respective horizontal planes when face shield hat 100 is worn in its intended orientation. For example, the orientation of hat brim 101 may be fixed relative to hat crown 102, with top brim surface 109 and bottom brim surface 110 extending substantially horizontally outward from the wearer's head. In some other examples, hat brim 101 may be a shape other than flat, such as curved, wavy, bendy, floppy, or any other shape or configuration. Hat brim 101 includes an outer brim edge 111 that is defined by a perimeter that is generally circular or oval in shape, although other shapes may be contemplated. Inner brim edge 112 is attached to hat crown 102 (e.g., to crown edge 115), forming a continuous junction between hat brim 101 and hat crown 102. Inner brim edge 112 may also be defined by a perimeter that is generally circular or oval in shape, although other shapes may be contemplated. The attachment method of hat brim 101 and hat crown 102 may vary and may be achieved through stitching, bonding, or other suitable techniques as discussed previously. Hat brim 102 may be made of one or more materials. The one or more materials may be selected from a variety of textiles, plastics, and/or composite materials based on desired properties such as flexibility, durability, water resistance, and/or weight.

Hat brim 101 includes snap fitting slots 106. For example, hat brim 101 may include seven snap fitting slots 106, or any other number of snap fitting slots 106. Snap fitting slots 106 are elongated recesses, channels, or holes designed to receive and securely hold tabs 108. Snap fitting slots 106 may be located circumferentially around at least a portion of hat brim 101. In some examples, a front brim portion 118 (FIG. 3) may include a first portion of snap fitting slots 106 that are located closer to outer brim edge 111 than inner brim edge 112, while a back brim portion 119 (FIG. 3) may include a second portion of snap fitting slots 106 that are closer to inner brim edge 112 than outer brim edge 111. Front brim portion 118 may be defined by the front half of hat brim 101, and back brim portion 119 may be defined by the back half of hat brim 101. In some examples, the first portion of snap fitting slots 106 of front brim portion 118 are closer to outer brim edge 111 than the second portion of snap fitting slots 106 of back brim portion 119. In some examples, the first portion of snap fitting slots 106 of front brim portion 118 are further from inner brim edge 112 than the second portion of snap fitting slots 106 of back brim portion 119. At least a portion of snap fitting slots 106 may be substantially equally spaced from one another on at least a portion of hat brim 101. For example, snap fitting slots 106 disposed in front brim portion 118 may be equally spaced from each other, and snap fitting slots 106 disposed in back brim portion 119 may be equally spaced from each other (e.g., at a different spacing than that of snap fitting slots 106 disposed in front brim portion 118). In some examples, front brim portion 118 may include more snap fitting slots 106 than back brim portion 119. For example, front brim portion 118 may include five snap fitting slots 106, and back brim portion 119 may include two snap fitting slots 106. At least a portion of snap fitting slots 106 disposed in back brim portion 119 (e.g., that are closer to inner brim edge 112 than outer brim edge 111) may be positioned so as to guide the corresponding portion of shield 103 to be closer to, proximal to, or in contact with the back of the head or the hair of a wearer. Shield 103 may be configured to attach to hat brim 101, for example, via the plurality of snap fitting slots 106 (e.g., via tabs 108), as discussed later, although substantially any other attachment mechanism is contemplated (e.g., Velcro, snap fitting buttons or pins, magnets, adhesives, and/or clips).

Hat brim 101 includes drawstring holes 107. Drawstring holes 107 are configured to receive at least one drawstring 104. In some examples, hat brim 101 may include six drawstring holes 107. In some examples, front brim portion 118 may include fewer drawstring holes 107 than back brim portion 119. For example, front brim portion 118 may include two drawstring holes, and back brim portion 119 may include four drawstring holes.

Hat crown 102 provides structural support for hat brim 101 and accommodates the wearer's head. Hat crown 102 may be generally shaped as a dome or truncated cone, although other shapes are contemplated, depending on the desired aesthetic and fit. Upper crown surface 113 and/or lower crown surface 114 (FIG. 2) are curved, conforming to the general shape of the human head. The curvature may vary in degree depending on the desired fit and style. Crown edge 115 may be attached to inner brim edge 112, forming a continuous perimeter. Hat crown 102 may be made of one or more materials. The one or more materials may be selected from a variety of textiles, plastics, and/or composite materials based on desired properties such as flexibility, durability, breathability, and/or weight.

Shield 103 is a transparent, protective barrier attached to hat brim 101. Shield 103 is configured to protect the wearer's head from airborne droplets and particles. In some examples, shield 103 includes a thin, rigid, semi-rigid, semi-flexible, or flexible sheet of transparent or semi-transparent material. In some examples, shield 103 is substantially nonporous. In some examples, hat brim 101, hat crown 102, and/or shield 103 may be made of a same material. For example, hat brim 101, hat crown 102, and/or shield 103 may be made of a same nonporous flat plastic sheeting. In some examples, hat brim 101, hat crown 102, and/or shield 103 may be manufactured via stamping (e.g., due to the thin nonporous flat plastic sheeting). In some examples, at least a portion of shield 103 is a substantially cylindrical shell with gap 120 (FIG. 2) in the substantially cylindrical shell. In some examples, shield 103 is attached to hat brim 101 around at least a portion of hat brim 101 and extends downwards from hat brim 101. For example, shield 103 may be attached to and wrap around at least a portion of a wearer's face, hat brim 101, or face shield hat 100. For example, shield 103 may be attached to and wrap around more than half of the wearer's face, hat brim 101, or face shield hat 100, with gap 120 disposed near or proximal to the back of face shield hat 100 or back brim portion 119 (e.g., opposite front shield portion 116). For example, a transverse cross section of shield 103 may define a major arc (e.g., approximately at least 270 degrees) when shield 103 is attached to hat brim 101. Gap 120 may provide a space for a wearer's back of head or hair to be disposed. Shield 103 may extend below the wearer's chin, providing coverage for the lower face. For example, front shield portion 116 may extend down further than the rest of shield 103 to cover a wearer's chin or to extend below the shoulders and/or to allow the wearer to eat or drink (e.g., while using a straw) without having to remove the face shield hat 100. In some examples, shield 103 may extend down to a wearer's body (e.g., shoulders, chest, back) to contact at least a portion of the wearer's body. For example, at least a portion of shield 103 may rest on a wearer's shoulders. In some examples, at least a portion of shield 103 may extend downwards but may not extend downwards so far so as to contact the wearer's body. In some examples, shield 103 may be shaped as a substantially cylindrical shell with a gap 120. For example, when laid flat or stretched out in a straight fashion, shield 103 may be a thin and substantially rectangular shape, aside from the lower extending portion of front shield portion 116. Shield 103 includes outside shield surface 125 and inside shield surface 126 (FIG. 2). In some examples, outside shield surface 125 and/or inside shield surface 126 is substantially perpendicular to bottom brim surface 110. In some examples, at least a portion of front shield portion 116 may be located closer to outer brim edge 111 than inner brim edge 112, while at least a portion of back shield portion 127 (FIG. 2) may be closer to inner brim edge 112 than outer brim edge 111. For example, first back shield edge 128 (FIG. 2) may be closer to inner brim edge 112 than outer brim edge 111, and second back shield edge 129 (FIG. 2) may be closer to inner brim edge 112 than outer brim edge 111. Gap 120 may be defined between first back shield edge 128 and second back shield edge 129. In some examples, the at least portion of front shield portion 116 may be located closer to outer brim edge 111 than the at least portion of back shield portion 127 (e.g., than back shield edge 128 and/or back shield edge 129). Front shield portion 116 may be defined by the front half of shield 103 or any portion of shield 103 that is in the front half of face shield hat 100, and back shield portion 127 may be defined by the back half of shield 103 or any portion of shield 103 that is in the back half of face shield hat 100.

Shield 103 may include tabs 108. For example, tabs 108 may be attached to or form a single integral part with shield 103. Tabs 108 may be made of a same or different material as shield 103. Tabs 108 may protrude upwards from an upper shield edge 117 (FIG. 2) and may be configured to be received by, fit, and/or snap into snap fitting slots 106 of hat brim 101. Tabs 108 may be substantially square or rectangular in shape, although any other shape is contemplated.

At least one drawstring 104 is a flexible cord or strip of fabric. The at least one drawstring 104 may be made from a variety of materials, including cotton, polyester, nylon, elastic, or a combination of these. The at least one drawstring 104 is configured to fit through the drawstring holes 107. For example, during assembly or threading of the at least one drawstring 104 through drawstring holes 107, one may insert a first end of the at least one drawstring 104 down through drawstring hole 107-*a* and a second end of the at least one drawstring 104 down through drawstring hole 107-*b*. Then, one may pull the first end of the at least one drawstring 104 up through drawstring hole 107-*c*, and the second end of the at least one drawstring 104 up through drawstring hole 107-*d*. Then, one may pull the first end of the at least one drawstring 104 around hat brim 102 and down through drawstring hole 107-*e*, and the second end of the at least one drawstring 104 around hat brim 102 (opposite of the direction, with respect to hat brim 102, of the first end of the at least one drawstring 104) and down through drawstring hole 107-*f*. In some examples, one may tie knots 130 (e.g., simple overhand knots) in the at least one drawstring 104 at any portion of the at least one drawstring 104, such as first and second knots 130 approximately at the location at or immediately below drawstring hole 107-*c* and drawstring hole 107-*d*, respectively (e.g., at an underside of hat brim 102, such as adjacent to bottom brim surface 110). This may enable one to wear the face shield hat 100 multiple times without adjusting the at least one drawstring 104 each time. As such, when the at least one drawstring 104 is through the drawstring holes 107, first drawstring portion 121 (FIG. 4) may extend between drawstring hole 107-*a* and drawstring hole 107-*c*, and second drawstring portion 122 (FIG. 4) may extend between drawstring hole 107-*b* and drawstring hole 107-*d* both underneath face shield hat 100 (e.g., underneath hat crown 102 and/or hat brim 101). In this way, first drawstring portion 121 and second drawstring portion 122 may be configured to rest atop a head of a wearer between the wearer's head and hat crown 102. As such, when the face shield hat 100 is worn, there may be a gap (e.g., approximately half an inch) between the wearer's head and hat crown 102 (e.g., lower crown surface 114). The gap may be between first drawstring portion 121 and/or second drawstring portion 122, and hat crown 102 (e.g., lower crown surface 114). This is configured to prevent the face shield hat 100 from touching the wearer, except for first drawstring portion 121, second drawstring portion 122, third drawstring portion 123, and fourth drawstring portion 124. This configuration also entrains the wearer's exhaled air to pass through the wearer's hair at the top and back of the wearer's head (e.g., near gap 120), thereby converting the wearer's hair to a 'mask' to filter the wearer's virus from reaching the crowd around the wearer. Third drawstring portion 123 (FIG. 4) and fourth drawstring portion 124 (FIG. 4) may be configured to extend downwards below hat brim 101 and/or hat crown 102. For example, third drawstring portion 123 may be configured to extend downwards from drawstring hole 107-*e* and fourth drawstring portion 124 may be configured to extend downwards from drawstring hole 107-*f*. In this way, third drawstring portion 123 and fourth drawstring portion 124 may hang down, be attached to drawstring lock 105, and be configured to wrap under a chin of a wearer for increased stability.

Drawstring lock 105 is a device designed to secure the position of the at least one drawstring 104. This prevents unintentional or unauthorized adjustment of the at least one drawstring 104. Drawstring lock 105 may be made from plastic, metal, or any other material, or a combination of materials. Drawstring lock 105 may include housing with a mechanism to clamp or grip the at least one drawstring 104. The mechanism may include teeth, jaws, and/or a tightening band. The at least one drawstring 104 may include a release mechanism to allow for adjustment of the at least one drawstring 104.

In some examples, when face shield hat 100 is worn by a wearer, the wearer may not need to additionally wear a conventional face mask, as the wearer's hair on top as well as at the back of the wearer's head may substitute for the conventional face mask (e.g., under the right conditions, for example, in an enclosed public venue when the ceiling is high and/or in the morning hours, in which case most of a virus cloud may still be primarily above the wearer's head). For example, face shield hat 100 may allow for the wearer's exhaled air to pass through the wearer's hair at the top and back of the wearer's head, thereby converting the wearer's hair to a 'mask' to filter the wearer's virus.

As will be understood by those of skill in the art, any reference to "top," "bottom," "front," "rear," "back," "side," "above," "below," etc. are used to describe face shield hat 100 when in the orientation shown, for example, in the figures, or alternatively with respect to a normal and standard orientation of face shield hat 100 (e.g., when worn by a wearer in a standard upright configuration) as is understood by one of ordinary skill in the art (e.g., front refers to a direction towards the face of a wearer, top refers to a direction away from the ground, below refers to a direction towards the ground, etc.); however, the components described herein can be utilized in a variety of orientations.

Those skilled in the art will recognize that the methods and systems of the present disclosure may be implemented in many manners and as such are not to be limited by the foregoing aspects and examples. In this regard, any number of the features of the different aspects described herein may be combined into single or multiple aspects, and alternate aspects having fewer than or more than all of the features herein described are possible. Functionality may also be, in whole or in part, distributed among multiple components, in manners now known or to become known.

Moreover, the scope of the present disclosure covers conventionally known manners for carrying out the described features and functions, and those variations and modifications that may be made to the components described herein as would be understood by those skilled in the art now and hereafter.

Further, as used herein and in the claims, the phrase "at least one of element A, element B, or element C" is intended to convey any of: element A, element B, element C, elements A and B, elements A and C, elements B and C, and elements A, B, and C. In addition, one having skill in the art will understand the degree to which terms such as "about" or "substantially" convey in light of the measurements techniques utilized herein. To the extent such terms may not be clearly defined or understood by one having skill in the art, the term "about" shall mean plus or minus ten percent, and when used with respect to angular measurements, the term "substantially" shall mean within plus or minus ten degrees (e.g., "substantially perpendicular" shall mean within ten degrees from exactly perpendicular, and "substantially parallel" shall mean within ten degrees from exactly parallel).

Numerous other changes may be made which will readily suggest themselves to those skilled in the art and which are encompassed in the spirit of the disclosure and as defined in the appended claims. While various aspects have been described for purposes of this disclosure, various changes and modifications may be made which are well within the scope of the disclosure. Numerous other changes may be made which will readily suggest themselves to those skilled in the art and which are encompassed in the spirit of the disclosure and as defined in the claims.

What is claimed is:

1. A face shield hat, comprising:

a hat brim;

a hat crown attached to the hat brim;

a shield configured to be attached to the hat brim around at least a portion of the hat brim and configured to extend downwards from the hat brim; and at least one drawstring, wherein the hat brim has a plurality of drawstring holes configured to receive the at least one drawstring, the at least one drawstring comprising:

a first drawstring portion of the at least one drawstring configured to extend from a first drawstring hole of the plurality of drawstring holes defined in the hat brim to a second drawstring hole of the plurality of drawstring holes defined in the hat brim, a second drawstring portion of the at least one drawstring configured to extend from a third drawstring hole of the plurality of drawstring holes defined in the hat brim to a fourth drawstring hole of the plurality of drawstring holes defined in the hat brim, a third drawstring portion of the at least one drawstring configured to extend from a fifth drawstring hole of the plurality of drawstring holes defined in the hat brim, and a fourth drawstring portion of the at least one drawstring configured to extend from a sixth drawstring hole of the plurality of drawstring holes defined in the hat brim.

2. The face shield hat of claim 1, wherein a first back shield edge and a second back shield edge of the shield are closer to an inner brim edge of the hat brim than an outer brim edge of the hat brim, and wherein a front shield portion of the shield is closer to the outer brim edge than the inner brim edge.

3. The face shield hat of claim 1, wherein an outside surface of the shield is substantially perpendicular to a bottom surface of the hat brim.

4. The face shield hat of claim 1, wherein the shield wraps around more than half of the face shield hat.

5. The face shield hat of claim 1, wherein the hat brim has a plurality of snap fitting slots.

6. The face shield hat of claim 5, wherein the shield has a plurality of snap fitting tabs configured to snap into the plurality of snap fitting slots.

7. The face shield hat of claim 1, wherein the first drawstring portion and the second drawstring portion are configured to rest atop a head of a wearer of the face shield hat, and when the first drawstring portion and the second drawstring portion rest atop the head of a wearer of the face shield hat, there is a gap between the head of the wearer of the face shield hat and a lower crown surface of the hat crown.

8. The face shield hat of claim 1, wherein the first drawstring portion and the second drawstring portion are disposed underneath the face shield hat.

9. The face shield hat of claim 1, wherein a first knot is tied in the at least one drawstring below the second drawstring hole and at an underside of the hat brim, and wherein a second knot is tied in the at least one drawstring below the fourth drawstring hole at the underside of the hat brim.

10. The face shield hat of claim 9, wherein the first knot and the second knot tied in the at least one drawstring are disposed immediately below the second drawstring hole and immediately below the fourth drawstring hole, respectively.

11. The face shield hat of claim 1, wherein the third drawstring portion and the fourth drawstring portion are attached to a drawstring lock.

12. The face shield hat of claim 1, wherein the shield comprises a front shield portion that extends further downwards than a rest of the shield.

13. The face shield hat of claim 1, wherein at least a portion of the shield is a cylindrical shell with a gap.

14. The face shield hat of claim 13, wherein the gap is disposed opposite a front shield portion of the shield.

15. The face shield hat of claim 1, wherein a transverse cross section of the shield defines a major arc.

16. The face shield hat of claim 1, wherein the hat brim, the hat crown, and the shield are made of a same nonporous flat plastic sheeting material.

17. A face shield hat, comprising:

a hat brim;

a hat crown attached to the hat brim;

a shield configured to be attached to the hat brim around at least a portion of the hat brim and configured to extend downwards from the hat brim, wherein the shield includes a plurality of tabs; and at least one drawstring, the at least one drawstring comprising:

a first drawstring portion of the at least one drawstring configured to extend from a first drawstring hole of the plurality of drawstring holes defined in the hat brim to a second drawstring hole of the plurality of drawstring holes defined in the hat brim, a second drawstring portion of the at least one drawstring configured to extend from a third drawstring hole of the plurality of drawstring holes defined in the hat brim to a fourth drawstring hole of the plurality of drawstring holes defined in the hat brim, a third drawstring portion of the at least one drawstring configured to extend from a fifth drawstring hole of the plurality of drawstring holes defined in the hat brim, and a fourth drawstring portion of the at least one drawstring configured to extend from a sixth drawstring hole of the plurality of drawstring holes defined in the hat brim, wherein the hat brim has a plurality of snap fitting slots, and wherein each tab of the plurality of tabs is configured to fit into a respective snap fitting slot of the plurality of snap fitting slots.

* * * * *